US011536271B2

(12) United States Patent
Lee et al.

(10) Patent No.: US 11,536,271 B2
(45) Date of Patent: Dec. 27, 2022

(54) SEALING DEVICE FOR OIL INJECTION-TYPE SCREW COMPRESSOR

(71) Applicant: Jae Young Lee, Seoul (KR)

(72) Inventors: Jae Young Lee, Seoul (KR); Kil Won Son, Gyeonggi-do (KR); Yu Sang Han, Gyeonggi-do (KR)

(73) Assignee: Jae Young Lee, Seoul (KR)

( * ) Notice: Subject to any disclaimer, the term of this patent is extended or adjusted under 35 U.S.C. 154(b) by 146 days.

(21) Appl. No.: 16/758,340

(22) PCT Filed: Dec. 14, 2018

(86) PCT No.: PCT/KR2018/015907
§ 371 (c)(1),
(2) Date: Apr. 22, 2020

(87) PCT Pub. No.: WO2019/124880
PCT Pub. Date: Jun. 27, 2019

(65) Prior Publication Data

US 2020/0256338 A1 Aug. 13, 2020

(30) Foreign Application Priority Data

Dec. 21, 2017 (KR) ..... 10-2017-0176915

(51) Int. Cl.
*F04C 18/16* (2006.01)
*F04C 27/00* (2006.01)
(Continued)

(52) U.S. Cl.
CPC ..... *F04C 29/02* (2013.01); *F04C 18/16* (2013.01); *F04C 27/009* (2013.01); *F04C 2210/22* (2013.01)

(58) Field of Classification Search
CPC ..... F04C 29/02; F04C 29/026; F04C 27/009; F04C 18/16; F04C 15/0034; F16J 15/002; F16J 15/004; F16J 15/3232; F16J 15/164
See application file for complete search history.

(56) References Cited

U.S. PATENT DOCUMENTS 3,975,123 A * 8/1976 Schibbye ..... F04C 27/009 418/97
5,836,753 A * 11/1998 Takei ..... F02B 33/36 418/104
(Continued)

FOREIGN PATENT DOCUMENTS

JP H07-317553 A 12/1995
JP 2002349462 A 12/2002
(Continued)

OTHER PUBLICATIONS

International Search Report and Written Opinion corresponding to PCT/KR2018/015907 dated Mar. 14, 2019.

*Primary Examiner* — Deming Wan
(74) *Attorney, Agent, or Firm* — ArentFox Schiff LLP

(57) ABSTRACT

A screw compressor of the present invention comprises: a housing having a compression chamber; male and female rotors provided in the compression chamber; a driving shaft for rotating the male and female rotors; and a seal cover across which the driving shaft is provided, and further includes: an oil chamber provided at the seal cover, and returning, to the compression chamber, oil having leaked into the driving shaft; and a breather for injecting external air into the oil chamber. Therefore, the breather is provided at the upper part of the oil chamber and an oil recovery line is provided at the lower part thereof so as to cause a pressure difference between the upper and lower parts of the oil
(Continued)

chamber, such that the flow of the oil having leaked into the driving shaft is smoothly recovered in the oil recovery line.

4 Claims, 5 Drawing Sheets

(51) Int. Cl.

| | |
|---|---|
| ***F16K 15/00*** | (2006.01) |
| ***F04C 15/00*** | (2006.01) |
| ***F04C 29/02*** | (2006.01) |

(56) References Cited

U.S. PATENT DOCUMENTS

| | | | | |
|---|---|---|---|---|
| 6,095,780 | A * | 8/2000 | Ernens | F16J 15/002 418/104 |
| 2008/0240963 | A1* | 10/2008 | Kimura | F04C 27/009 418/104 |
| 2011/0135528 | A1* | 6/2011 | Amano | F04C 18/16 418/206.6 |
| 2017/0306959 | A1 | 10/2017 | Yano et al. | |

FOREIGN PATENT DOCUMENTS

| | | | |
|---|---|---|---|
| JP | 2008255798 | A | 10/2008 |
| JP | 2011163205 | A | 8/2011 |
| KR | 20170045292 | A | 4/2017 |

* cited by examiner

SEALING DEVICE FOR OIL INJECTION-TYPE SCREW COMPRESSOR

This application is a U.S. National Stage entry under 35 U.S.C. § 371 based on International Application PCT/KR2018/015907, filed on Dec. 14, 2018, which claims the benefit of priority to KR 10-2017-0176915, filed Dec. 21, 2017 which is incorporated herein by reference in its entirety.

TECHNICAL FIELD

The present invention relates to an oil injection-type screw compressor, and more particularly, to a sealing device for an oil injection-type screw compressor for recovering oil leaking into a drive shaft.

BACKGROUND ART

In general, a screw compressor is a device that produces compressed air by sucking, compressing, and discharging a working fluid (hereinafter referred to as "air") by a change in a sealing space caused between a pair of male and female rotors and a housing when the male and female rotors engage and rotate in opposite directions.

The operation of the screw compressor will now be described in detail. During rotation of a drive shaft connected to an electric motor, as the male and female rotors in the housing rotate, the inside of the housing is brought into a vacuum state to suck air in the atmosphere through a suction port, and as the volume of a compression chamber composed of the male and female rotors and the housing changes, the sucked air is turned into high-temperature and high-pressure compressed air, which is discharged through a discharge port.

The male and female rotors rotate at a high speed in the housing to obtain high-pressure air. At this time, the air becomes a high-temperature and high-pressure fluid according to the volume change, and since the high-temperature distribution is continuously maintained, it is necessary to secure an effective cooling system to prevent deterioration of durability of components such as rotors, etc.

The oil injection-type screw compressor, to which the cooling system is applied, compresses air at an atmospheric pressure of 0 bar and at a temperature of 20° C. to about 7 to 13 bar. At this time, the discharge temperature rises to about 300° C., which causes damage to the components including bearings, and thus the temperature of the compressed air is maintained within 80° C. by injecting oil corresponding to 1% of the amount of air sucked into the compression chamber in the housing during the compression.

However, among the components of the oil-injection type screw compressor, the component connected to the atmosphere is the drive shaft, and the compression chamber injects the oil for lubrication, sealing and cooling, and thus the high-pressure oil leaks into the atmosphere through the drive shaft, which is problematic.

In order to solve this problem, complex and expensive mechanical seals have been used in the past, and in recent years, most screw compressor manufacturers are intended to prevent leakage using lip seals, but in reality, the problem of leakage in the oil injection-type screw compressors occurs constantly, resulting in customer claims.

Conventional techniques for preventing oil leakage will be described with reference to FIGS. 1 to 3.

As shown in FIG. 1, a single lip seal 11 is applied to the outer circumferential surface of a drive shaft 10, which lowers the unit cost and simplifies the structure, but it is vulnerable to external dust, and in the event of leakage, oil leaks into the atmosphere immediately, leading to reliability problems.

As illustrated in FIG. 2, in order to supplement the single lip seal of FIG. 1, a double lip seal 12 is used as a primary seal provided on the outer circumferential surface of the drive shaft 10 to prevent oil leakage, which improves the durability, and a single lip seal 11 is used as a secondary seal provided on the outer circumferential surface of the drive shaft 10 to protect the primary seal from external dust.

However, according to the above method, in the event of oil leakage in the double lip seal, the oil can easily leak from the single lip seal, and thus the oil leakage cannot be prevented by the method.

As shown in FIG. 3, two single lip seals 11 and 12 are provided on the outer circumferential surface of the drive shaft 10, and for the case of leakage from the primary single lip seal 11, a recovery line 13 is provided to recover the leaking oil into the housing, thereby preventing the oil from leaking into the atmosphere According to the above method, during operation, the suction side of the housing is brought into sub-atmospheric pressure to recover the leaking oil into the housing through the recovery line 13, and during deactivation of the compressor, high-pressure oil is filled in the housing, and thus a check ball 14 is used to prevent the oil from flowing backward.

However, according to the above method, during load operation of the compressor, the vacuum pressure on the suction side of the housing is low, which does not facilitate the recovery, and during deactivation of the compressor, the internal pressure of the housing is released and becomes equal to the atmospheric pressure, which may cause the oil filled in the housing to flow backward to cause damage to the secondary single lip seal 12, and thus the oil leaks into the atmosphere.

Moreover, although the force of sucking the fluid in the space between the two single lip seals also acts during operation, when the space between the seals reaches a certain vacuum pressure, the oil recovery cannot be achieved.

Accordingly, there is a need to develop a more combined and improved type of sealing device for an oil injection-type screw compressor to recover the leaking oil in advance, thereby preventing the oil from leaking to the outside.

DISCLOSURE

Technical Problem

The present invention has been made to solve the above conventional problems, and an object of the present invention is to provide a sealing device for an oil injection-type screw compressor that facilitates the recovery of oil leaking into a drive shaft.

Technical Solution

To achieve the above object, the present invention provides a sealing device for an oil injection-type screw compressor comprising a housing having a compression chamber, male and female rotors provided in the compression chamber, a drive shaft for rotating the male and female rotors, and a seal cover across which the drive shaft is provided, and the screw compressor may further comprise: an oil chamber provided in the seal cover and returning oil, which leaks into the drive shaft, to the compression chamber; and a breather for injecting external air into the oil chamber.

Moreover, the screw compressor may further comprise a first lip seal provided between the seal cover and the drive shaft, and a second lip seal provided between the seal cover and the drive shaft, and the oil chamber may be provided between the first lip seal and the second lip seal to return the oil, which leaks from in the first lip seal, to the compression chamber.

Furthermore, the screw compressor may further comprise an air supply line for supplying high-pressure air to the breather, and an orifice may be provided in the air supply line In addition, the air supply line may be connected to an air oil separator tank to receive high-pressure air from which oil has been removed.

Additionally, the screw compressor may further comprise a recovery line for connecting the oil chamber and the compression chamber.

Moreover, the recovery line may be connected to an intake valve.

Furthermore, the intake valve or the recovery line may be further provided with a check valve for preventing backflow of oil.

Advantageous Effects

According to the sealing device for the oil injection-type screw compressor according to the present invention, with the oil chamber provided between the first lip seal and the second lip seal, the breather provided at the top of the oil chamber, and the recovery line provided at the bottom, there is a pressure difference between the top and bottom of the oil chamber, which facilitates the recovery of oil, which leaks into the drive shaft, into the recovery line.

MODE FOR INVENTION

Hereinafter, preferred embodiments of the present invention will be described in detail with reference to the accompanying drawings.

Figure 4:
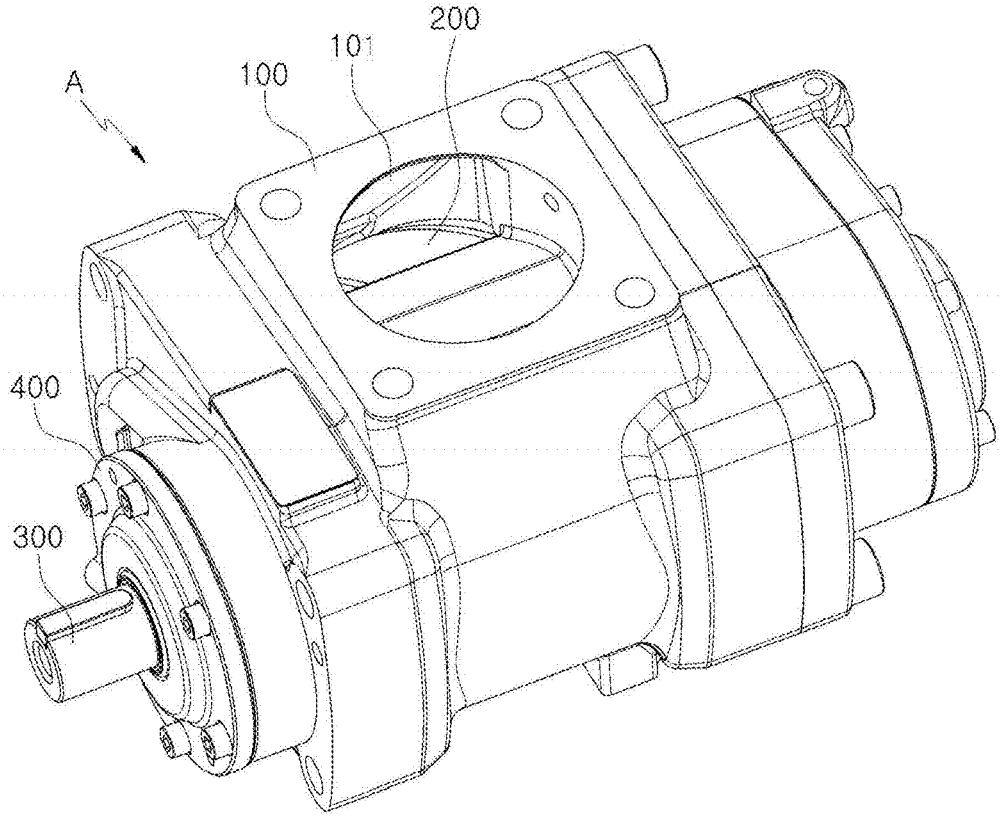
FIG. 4 is a perspective view showing a screw compressor according to the present invention.
Figure 5:
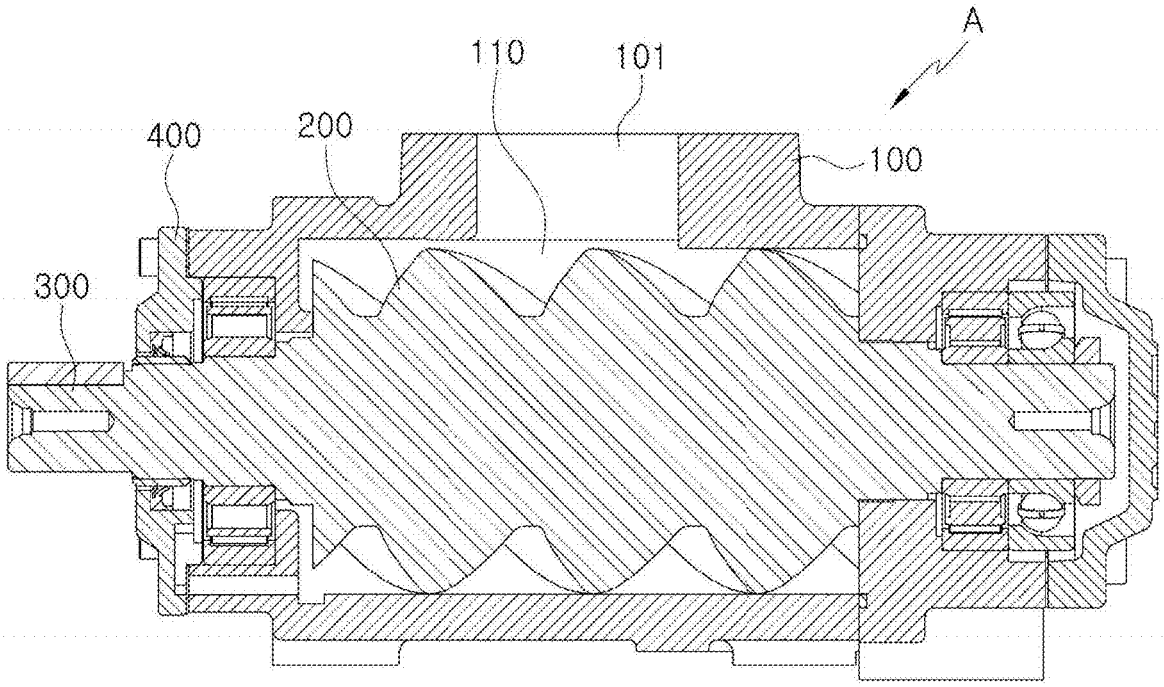
FIG. 5 is a cross-sectional view of FIG. 4.
Figure 6:
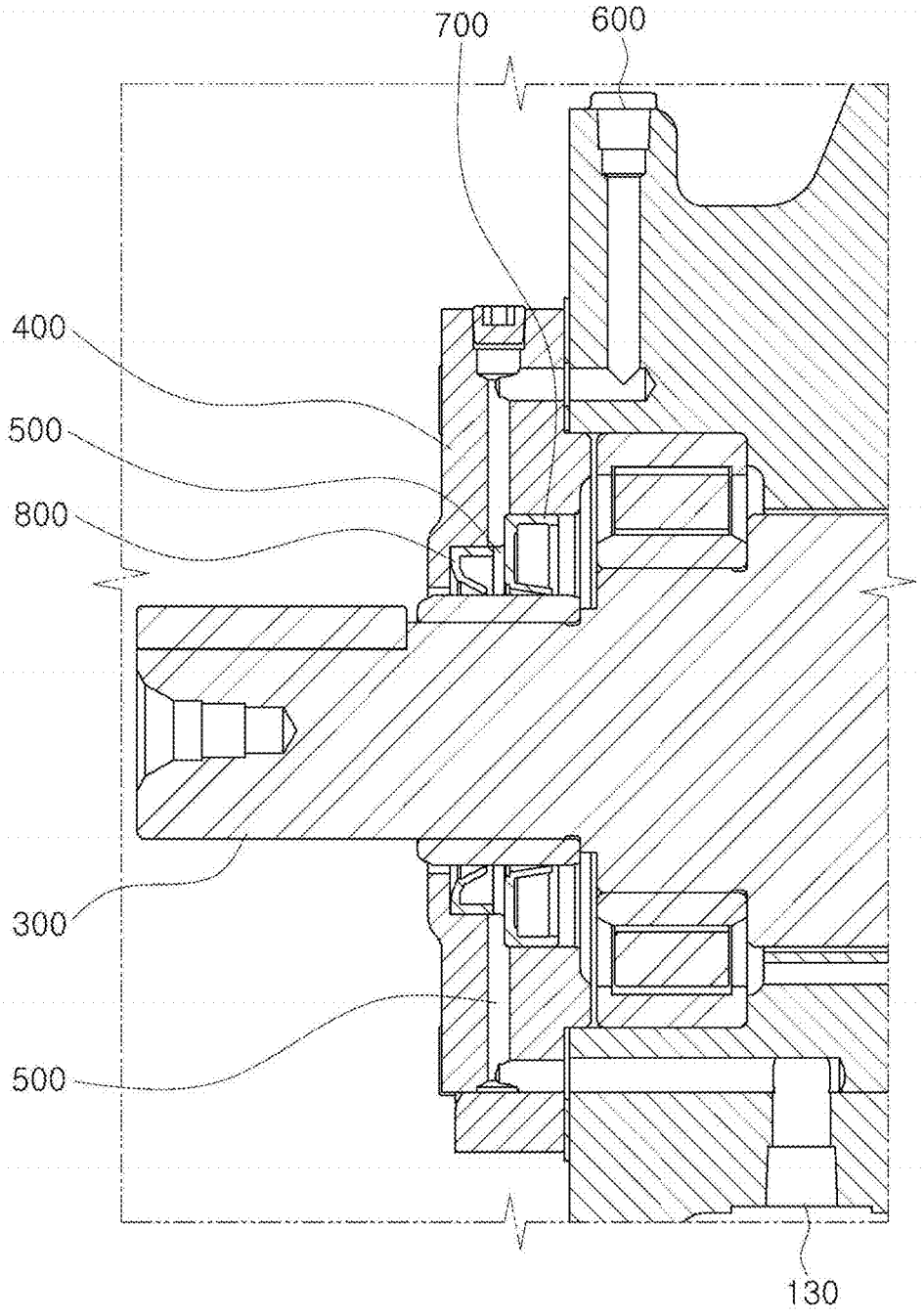
FIG. 6 is a partially enlarged cross-sectional view of FIG. 5.
Figure 7:
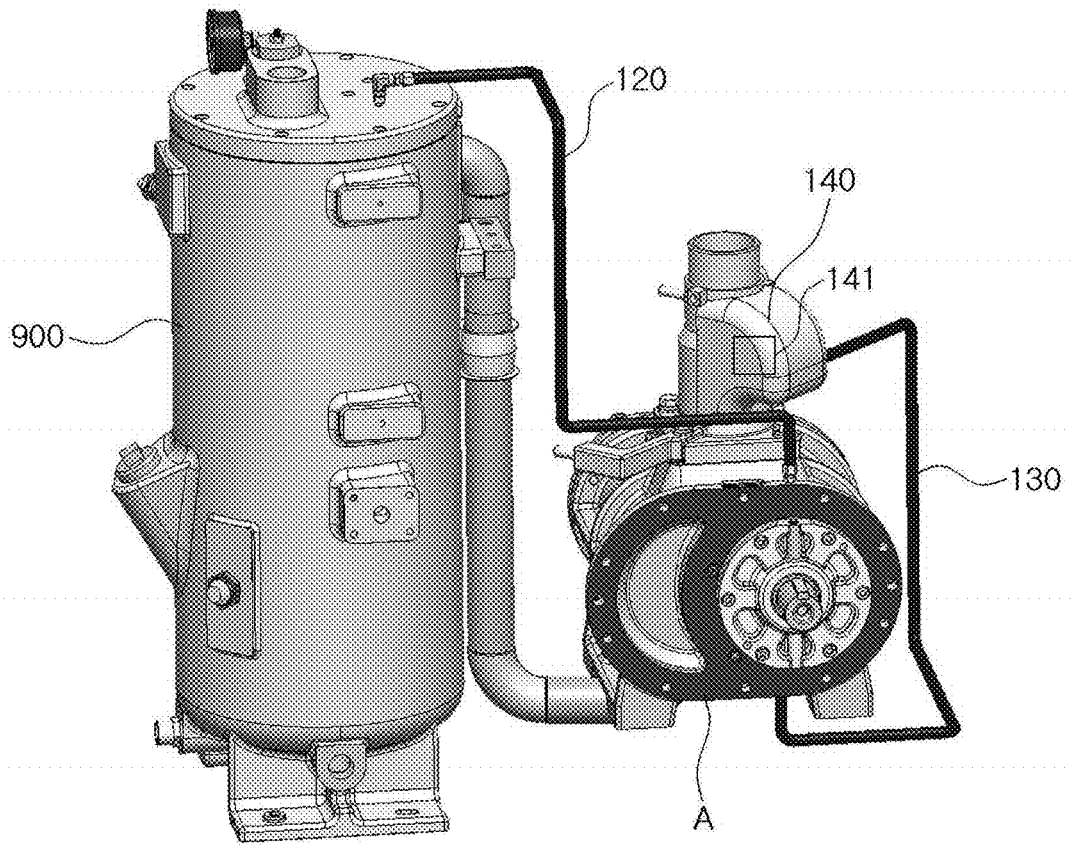
FIG. 7 shows a screw compressor and an air oil separator tank according to the present invention.

FIG. 4 is a perspective view showing a screw compressor according to the present invention, FIG. 5 is a cross-sectional view of FIG. 4, FIG. 6 is a partially enlarged cross-sectional view of FIG. 5, and FIG. 7 shows a screw compressor and an air oil separator tank according to the present invention.

As shown in FIGS. 4 to 7, a screw compressor A according to the present invention comprises a housing 100 having a compression chamber 110, male and female rotors 200 provided in the compression chamber 110, a drive shaft 300 for rotating the male and female rotors 200, and a seal cover across which the drive shaft 300 is provided.

According to this type of screw compressor, during rotation of the drive shaft 300 connected to an electric motor (not shown), as the male and female rotors 200 in the compression chamber 110 rotate, the compression chamber 110 in the housing is brought into a vacuum state to suck air in the atmosphere through a suction port 101, and as the volume of the compression chamber 110 composed of the male and female rotors 200 and the housing 100 changes, the sucked air is turned into high-temperature and high-pressure compressed air, which is discharged through a discharge port (not shown).

Moreover, the screw compressor A may further comprise an oil chamber 500 provided in the seal cover 400 and returning oil, which leaks into the drive shaft 300, to the compression chamber 110, and a breather 600 for injecting external air into the oil chamber 500.

As such, the oil chamber 500 does not reach the vacuum pressure by the breather 600, which improves the problem that the oil is not recovered.

Furthermore, the screw compressor may further comprise, a first lip seal 700 provided between the seal cover 400 and the drive shaft 300, and a second lip seal 800 provided between the seal cover 400 and the drive shaft 300, and the oil chamber 500 may be provided between the first lip seal 700 and the second lip seal 800 to recover the oil, which leaks from the first lip seal 700, into the compression chamber 110.

Meanwhile, the screw compressor may further comprise an air supply line 120 for supplying high-pressure air to the breather 600, and an orifice may be provided in the air supply line 120.

In addition, the air supply line 120 may be connected to an air oil separator tank 900 to receive high-pressure air from which oil has been removed. However, the source of high-pressure air is not particularly limited to the air oil separator tank 900, and a portion of the discharge pressure of the compressor may be bypassed and used for that purpose.

Additionally, the screw compressor may further comprise a recovery line 130 for connecting the oil chamber 500 and the compression chamber 110.

Figure 1:
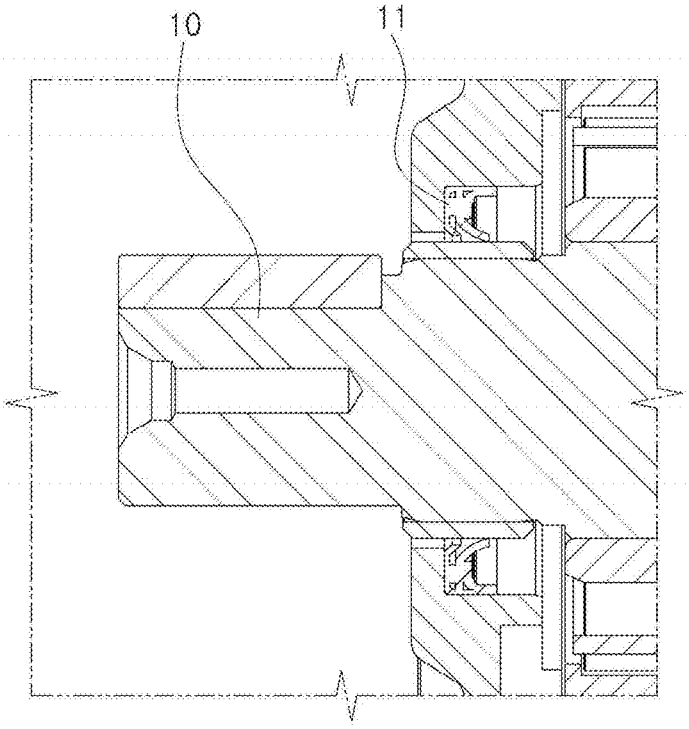
FIG.1 (prior art)
FIGS. 1 to 3 are cross-sectional views showing screw compressors according to the prior art.
Figure 2:
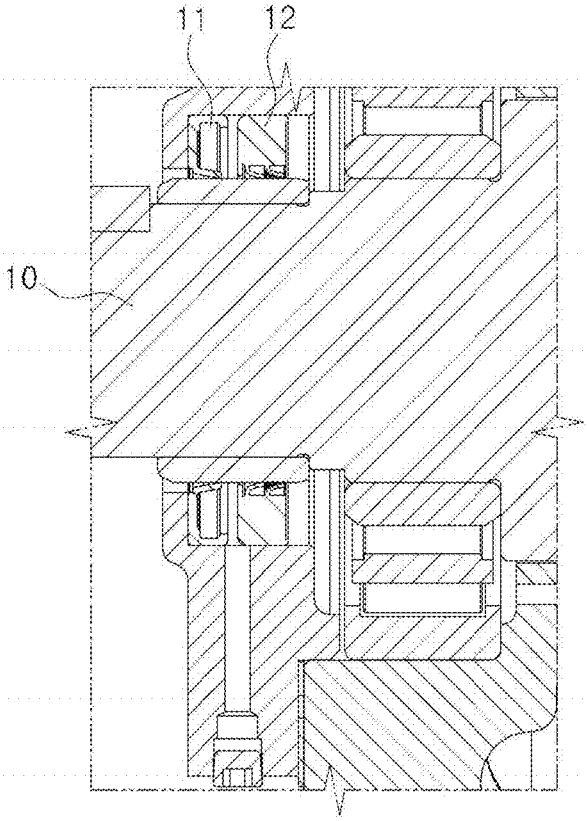
FIG.2 (prior art)
Figure 3:
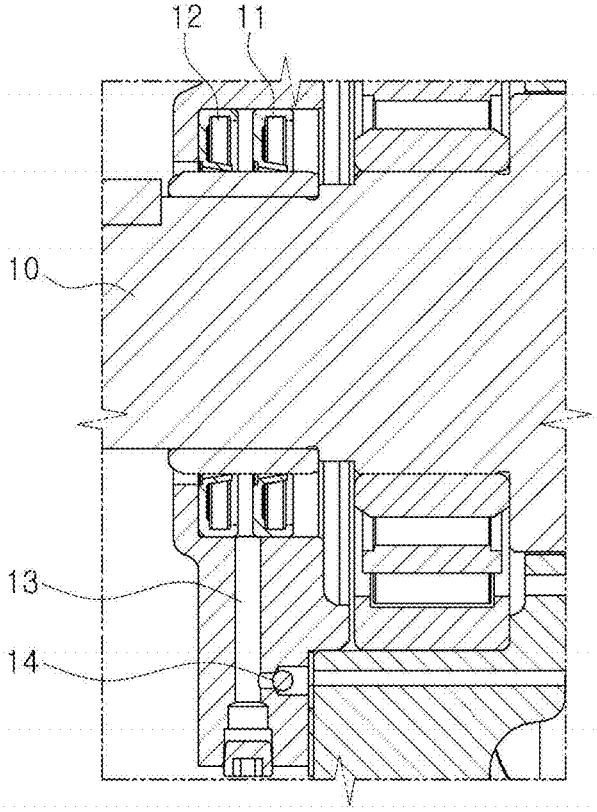
FIG.3 (prior art)

As such, with the oil chamber 500 provided between the first lip seal 700 and the second lip seal 800, the breather 600 provided at the top of the oil chamber 800, and the recovery line 130 provided at the bottom, there is a pressure difference between the top and bottom of the oil chamber, which facilitates the flow of the leaking oil into the recovery line 130. That is, the problem of reaching the vacuum pressure in FIG. 3 is solved.

Furthermore, the recovery line 130 may be connected to an intake valve 140, and the intake valve 140 or the recovery line 130 may be further provided with a check valve 141 for preventing backflow of oil.

As such, the air supplied to the space of the oil chamber 500 through the breather 600 passes through the oil separator 900 to supply high-pressure air from which oil has been removed. Here, if the diameter of the air supply line 120 is large, there is a loss of compressed air, and thus an orifice is provided in the air supply line 120, and the diameter is set to ø 0.5 to 2 mm.

Moreover, when the intake valve 140 is a loading/unloading valve, the recovery line 130 is provided between an inlet of the intake valve 140 and the check valve 141 in the intake valve. That is, during loading or unloading operation, suction is created by vacuum in the recovery line 130 to facilitate the oil recovery, and during deactivation, the backflow of oil in the compression chamber 110, which has been problematic in the prior art, is blocked by the check valve 141 in the intake valve 140, thereby preventing the oil from flowing backward into the space between the seals.

According to the present invention, with the oil chamber 500 provided between the first lip seal 700 and the second lip seal 800, the breather 600 provided at the top of the oil chamber 800, and the recovery line 130 provided at the bottom, there is a pressure difference between the top and bottom of the oil chamber 500, which facilitates the recovery of oil, which leaks into the drive shaft 300, into the recovery line 130.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

The invention claimed is:

1. A screw compressor comprising a housing having a compression chamber, male and female rotors provided in the compression chamber, a drive shaft for rotating the male and female rotors, and a seal cover across which the drive shaft is provided, the screw compressor further comprising:

an oil chamber provided in the seal cover and returning oil, which leaks into the drive shaft, to the compression chamber;

a breather for injecting external air into the oil chamber;

a first lip seal provided between the seal cover and the drive shaft;

a second lip seal provided between the seal cover and the drive shaft, wherein the oil chamber is provided between the first lip seal and the second lip seal to return the oil, which leaks from in the first lip seal, to the compression chamber; and a recovery line directly connected to the oil chamber to connect the oil chamber and the compression chamber, wherein the recovery line is connected to an intake valve.

2. The screw compressor according to claim 1, further comprising an air supply line for supplying high-pressure air to the breather, wherein an orifice is provided in the air supply line.

3. The screw compressor according to claim 2, wherein the air supply line is connected to an air oil separator tank to receive the high-pressure air from which oil has been removed.

4. The screw compressor according to claim 1, wherein the intake valve or the recovery line is further provided with a check valve for preventing backflow of oil.

* * * * *